US006812649B2

(12) United States Patent
Kim

(10) Patent No.: US 6,812,649 B2
(45) Date of Patent: Nov. 2, 2004

(54) DEVICE AND METHOD FOR CONTROLLING LCD BACKLIGHT

(75) Inventor: Se Hwan Kim, Inchoen-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/176,113

(22) Filed: Jun. 21, 2002

(65) Prior Publication Data

US 2002/0195954 A1 Dec. 26, 2002

(30) Foreign Application Priority Data

Jun. 22, 2001 (KR) ..... 2001-35872

(51) Int. Cl.[7] ..... H05B 41/36; G09G 3/36
(52) U.S. Cl. ..... 315/149; 315/169.3; 345/102
(58) Field of Search ..... 315/149, 169.3, 315/156–158, 30; 345/102, 211, 212, 101, 63, 77

(56) References Cited

U.S. PATENT DOCUMENTS 5,553,299 A * 9/1996 McPherson ..... 340/815.41
5,747,938 A * 5/1998 Beard ..... 315/169.3
5,854,617 A * 12/1998 Lee et al. ..... 345/102
5,952,992 A * 9/1999 Helms ..... 345/102
6,069,449 A * 5/2000 Murakami ..... 315/158
6,388,388 B1 * 5/2002 Weindorf et al. ..... 315/169.3
6,496,236 B1 * 12/2002 Cole et al. ..... 349/61
2002/0118182 A1 * 8/2002 Luther Weindorf ..... 345/204
2002/0158861 A1 * 10/2002 Maksimovic et al. ..... 345/211

* cited by examiner

*Primary Examiner*—Don Wong
*Assistant Examiner*—Chuc Tran
(74) *Attorney, Agent, or Firm*—Fleshner & Kim, LLP

(57) ABSTRACT

A backlight control device and method of an LCD can reduce or minimize the battery usage by a backlight lamp while maintaining the brightness of a reflective LCD at an adequate level by operating backlight control using intensity of detected surrounding light within a selected control range from a plurality of backlight control ranges. The backlight control ranges can vary in number but are directed into various levels, according to the intensity of surrounding light and use of a battery or an external power source.

23 Claims, 4 Drawing Sheets

11
12
13
LCD
B/L
17
14
Sensor
Power Supply
AC
Battery
15
20
Control
A/D Converter
Power Source Detector
16
21
Microcomputer
Memory
18
19
Keyboard Controller
Keyboard

| Table Number | Condition | | Backlight Control Range |
|---|---|---|---|
| 1 | external AC used | | 0 ---------- 100 % |
| 2 | Battery used | SLI (Surrounding Light Intensity) = Level 1 | 0 --------- 75 % |
| 3 | | SLI = Level 2 | 0 ----- 50 % |
| 4 | | SLI = Level 3 | 0 -- 25 % |

DEVICE AND METHOD FOR CONTROLLING LCD BACKLIGHT

BACKGROUND OF THE INVENTION

1. Field of the Invention

The present invention relates to a liquid crystal display (LCD) device and in particular to a backlight control device and method of a liquid crystal display device.

2. Background of the Related Art

Generally, various handheld electronics equipped with an LCD, such as a notebook computer, a personal digital assistance (PDA) and a web pad, contain a backlight control device to control variable brightness or to maintain the brightness of the LCDs. FIG. 1 is a schematic block diagram showing a backlight control device of a related art LCD. As shown in FIG. 1, the backlight control device includes a backlight lamp 3 mounted on the back of an LCD 1 to emit light, and a translucent mirror 2 having an intermittent form with multiple slits evenly spread out is mounted in between the backlight lamp 3 and the LCD 1 to enable use of light sources from both the backlight lamp 3 and external or ambient light. A light-sensor 4 measures intensity of the external or surrounding light, and an A/D converter 5 converts an electric signal, detected and generated by the light-sensor 4, into a digital signal. A power supply 7 converts the battery power or the external power source into a fixed amount driving current and then supplies the driving current to the backlight lamp 3. A microcomputer 6 selectively stops the driving current to the backlight lamp 3 according to the intensity of surrounding light detected by the light-sensor 4 and the A/D converter 5. A keyboard 9 is for a user to provide input via keys, and a keyboard controller 8 is for outputting key values, in correspondence with the key inputs, through the microcomputer 6.

An LCD type, which can utilize light sources from the backlight lamp 3 and the external light by placing the translucent mirror 2 in between the LCD 1 and the backlight lamp 3, is normally referred to as a reflective liquid crystal display. The power supply 7 uses an inverter to convert power into the driving current having the fixed amount.

The power supply 7 converts and supplies power into the fixed amount driving current, for example, a minimum of 1 mA to a maximum of 6 mA current, according to control of the microcomputer 6. The driving current then either emits the backlight lamp 3, or the driving current of the backlight lamp 3 is selectively cut-off according to control of the microcomputer 6.

In the case where intensity of surrounding light, detected by the light-sensor 4, meets the necessary light intensity to maintain the brightness of the reflective LCD without the backlight, the microcomputer 6 operates and controls the power supply 7, as described above, to cut-off the power supplied into the backlight lamp 3. Therefore, when the external light is enough to maintain the brightness of the reflective LCD, unnecessary use of battery power, that is used to emit the backlight, is prevented.

However, as described above the related art LCD backlight control method has various disadvantages. There exists a demand to increase or maximize the limited battery life by controlling the backlight operation, which consumes approximately 30% more power, more efficiently in the handheld electronics equipped with a reflective LCD.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

Another object of the present invention is to provide a backlight control device and method for a liquid crystal display (LCD) that controls the brightness of a backlight of the LCD, which can utilize light sources from both the external light and the backlight, according to intensity of surrounding light.

Another object of the present invention is to provide a backlight control device and method for an LCD to control the backlight operation depending on an intensity of surrounding light within a selected backlight control range that is selected from a plurality of backlight control ranges.

Another object of the present invention is to provide a backlight control device and method for an LCD that controls backlight operations depending on an intensity of surrounding light within a selected backlight control range that is selected from backlight control ranges that are determined into various levels according to the intensity of surrounding light and use of a battery or an external power source.

In order to achieve at least the above objects in a whole or in part, a backlight control device of an LCD in accordance with the present invention includes a backlight device that is capable of providing light to a display, a single light-sensor, wherein the single light sensor detects intensity of the ambient light, a power supply that selects either a battery or an external power source as a power source to provide driving power of the backlight device, a power source detector that detects the power source that provides the driving power of the backlight device and a backlight control device that comprises a control unit that controls the power supply to apply a backlight driving current in proportion to the detected intensity of the ambient light within a selected one of a plurality of backlight control ranges, wherein the plurality of backlight control ranges are designated into levels according to the ambient light intensity and the power source.

To further achieve at least the above objects in a whole or in part, in accordance with the present invention there is provided a brightness control method of an LCD that includes detecting a selected one of a plurality of power sources supplying a backlight, detecting intensity of surrounding light impinging the LCD, determining a plurality of backlight control ranges having different levels according to the surrounding light intensity and a power source, selecting a range from the backlight control ranges according to the detected surrounding light intensity and the detected power source and controlling a backlight driving current in proportion to the detected surrounding light intensity according to the selected backlight control range applied to the backlight.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Figure 1:
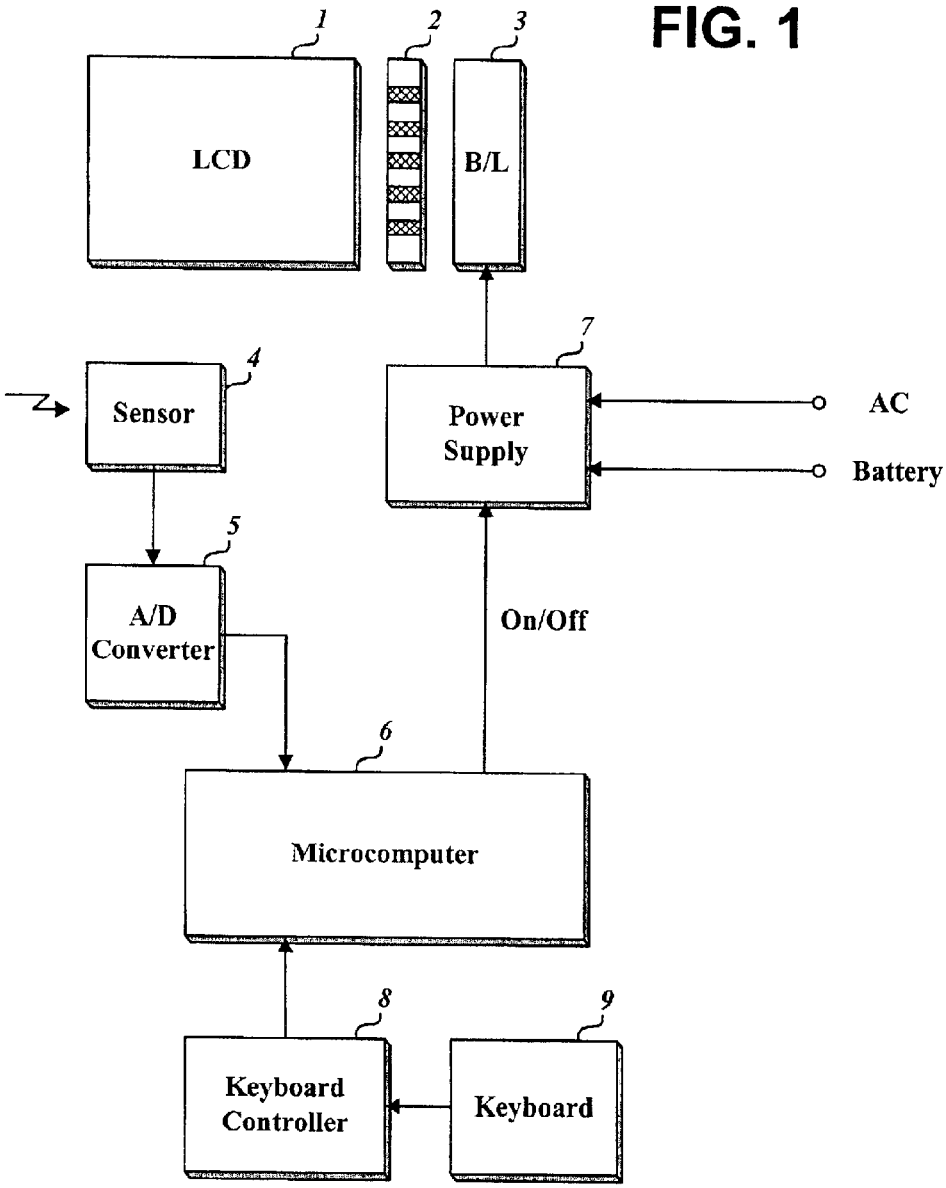
FIG. 1 Related Art
FIG. 1 is a schematic block diagram showing a backlight control device of a related art LCD.
Figure 2:
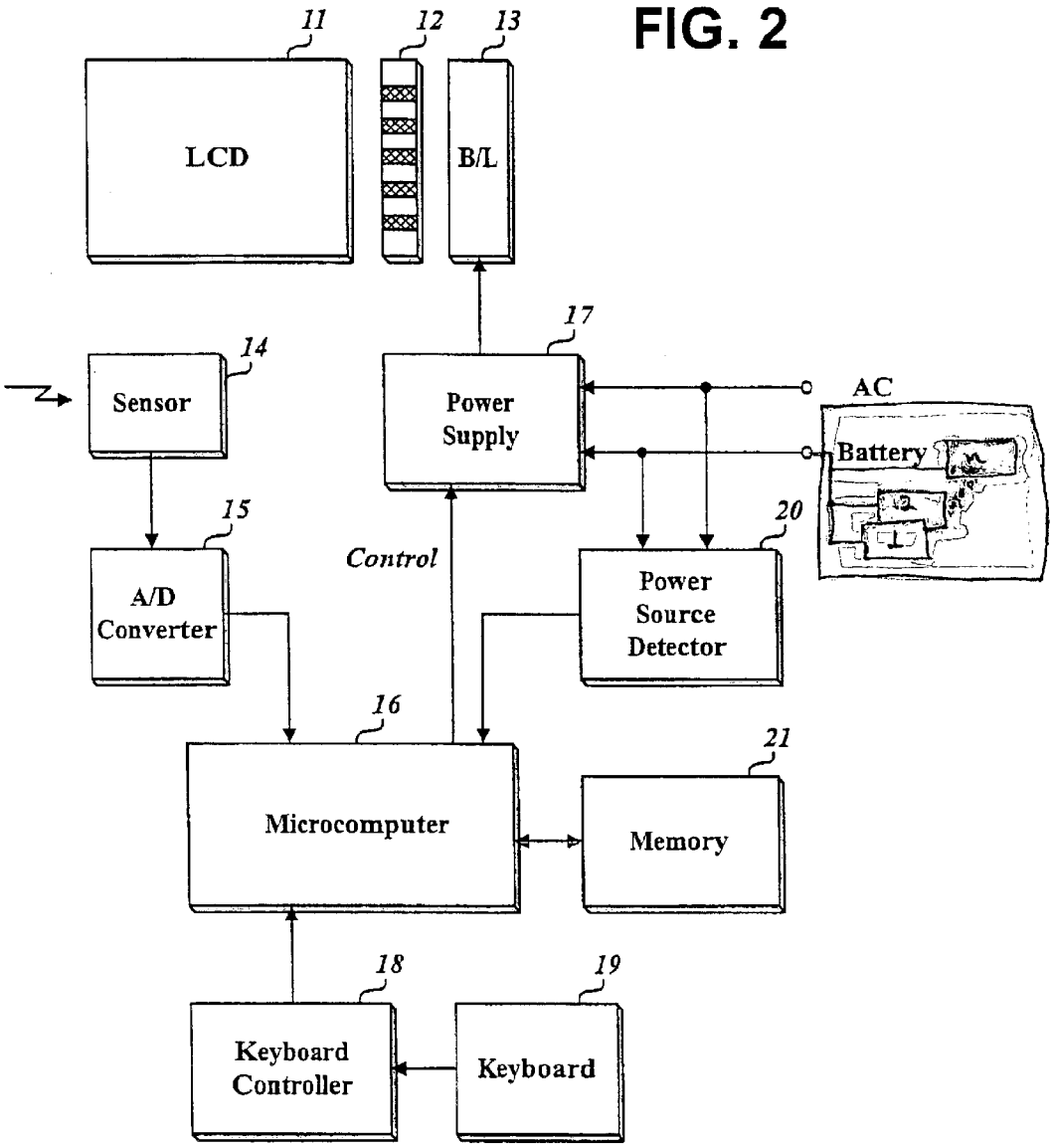
FIG. 2 is a schematic block diagram showing a preferred embodiment of a backlight control device of an LCD according to the present invention.

In order that the invention may be fully understood, preferred embodiments thereof will now be described with reference to the accompanying drawings. FIG. 2 is a schematic block diagram showing a preferred embodiments of a backlight control device of an LCD according to the present invention. As shown in FIG. 2, the backlight control device includes an LCD 11, a backlight 13, a translucent mirror 12, a light-sensor 14, an A/D converter 15, a power supply 17, a keyboard 19 and a keyboard controller 18 which are similar to related art described above with reference to FIG. 1. Accordingly, a detailed description is omitted here.

The preferred embodiment of the backlight control device as shown in FIG. 2 further includes a power source detector 20 that detects whether power is supplied from the battery or the external power source, a microcomputer 16 that determines and controls backlight control ranges into various levels based upon the detected power source and the intensity of surrounding light detected by the light-sensor 14, and a memory 21 that preferably stores the control data for the backlight control ranges that are determined into various levels.

In the power supply 17, an inverter can be used to convert and supply power of a fixed amount from the battery or the external power. Further, the power supply 17, in accordance with control of the microcomputer 16, can convert power from the battery e.g., batteries) or the external power into the fixed amount driving current, for example, having a value between a minimum or reduced driving current of 1 mA and a maximum or high driving current of 6 mA to illuminate the backlight.

Figures 3A, 3B:
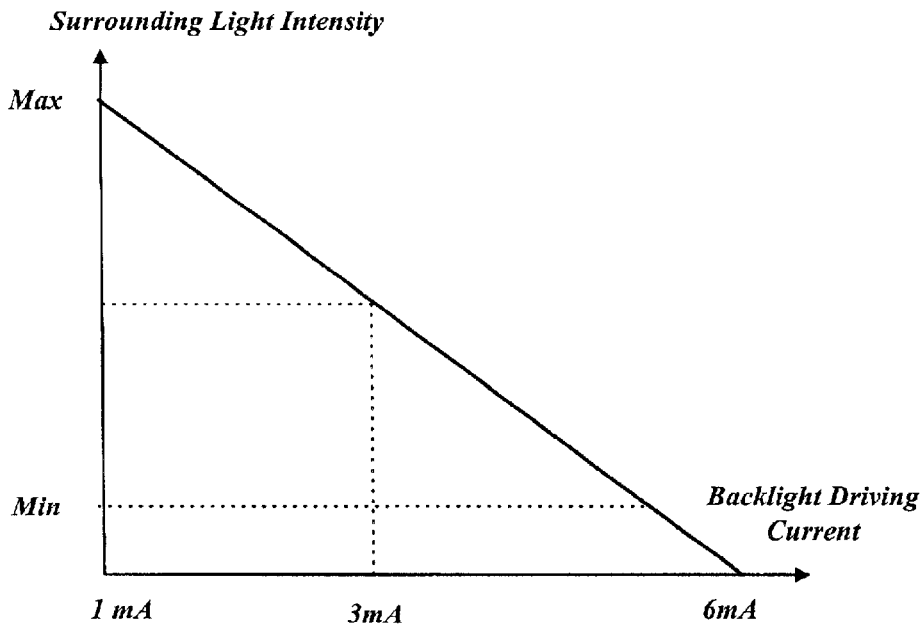
FIGS. 3*a* and 3*b* are diagrams that show backlight control ranges, and exemplary backlight driving current having a prescribed relationship to intensity of surrounding light of the present invention.

Moreover, in the microcomputer 16, a control range is to be selected from the backlight control ranges that are defined into various levels preferably in accordance with the intensity of surrounding light detected by the light-sensor 14 and the source power detected by the power source detector 20. As shown in FIG. 3*a,* exemplary backlight control ranges are defined into various table numbers (e.g., Table Number #1, #2, #3, #4) when stored into the memory 21.

In the table number #1 control range, control data for setting the backlight control range up to maximum of 100% is stored for the case where AC power is used as a source power with ambient light. In the table number #2 control range, the control data for setting the backlight control range up to maximum of 75% is stored for the case where a battery is being used as a source power, and the detected current, in correspondence with the intensity of surrounding light, meets the value of a Level 1 standard by being between 4 mA and 9 mA. In the table number #3 control range, the control data for setting the backlight control range up to a maximum of 50% is stored for the case where a battery is being used as a source power, and the detected current, in correspondence with the intensity of surrounding light, meets the value of a Level 2 standard by being between 10 mA and 14 mA. In the table number #4 control range, the control data for setting the backlight control range up to maximum of 25% is stored, in the case where a battery is being used as a source power, and the detected current, in correspondence with the intensity of surrounding light, meets the value of a Level 3 standard by being between 15 mA and 20 mA. The above ranges can be increased in number or have alternative maximums and therefore are not intended to limit the preferred embodiments of the present invention.

The data of the backlight driving current value, which is preferably inversely proportional to the intensity of surrounding light detected by the light-sensor, is stored into the memory 21. However, the present invention is not intended to be so limited as other relationships could be defined therebetween. As shown in FIG. 3*b,* the backlight driving current is shown in the form of a graph.

In the microcomputer 16, the backlight control ranges are defined into various levels at maximum 75%, 50% and 25% and a control range is restrictively selected. Further, the backlight control operations, which apply the backlight driving current that is inversely proportional to the intensity of surrounding light within the control range, is preferably automatically performed.

Figure 4:
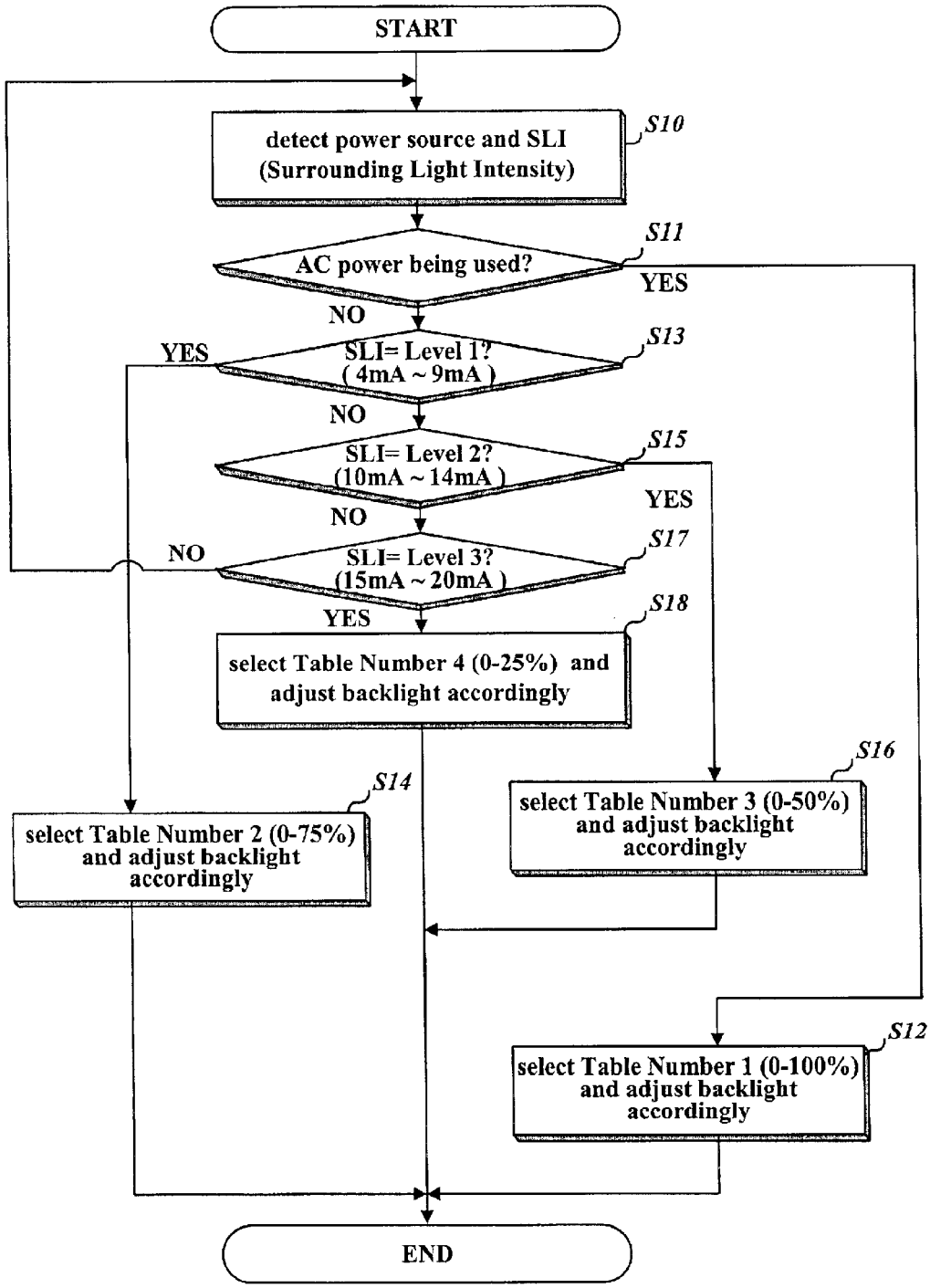
FIG. 4 is a flow chart showing a preferred embodiment of an LCD backlight control method according to the present invention.

FIG. 4 is a flow chart showing a preferred embodiment of an LCD backlight control method according to the present invention. The preferred embodiment of the LCD backlight control method, for example, can be performed by the backlight control device of FIG. 2, and will be described with reference to the same. However, the present invention is not intended to be so limited.

As shown in FIG. 4, after a process starts, the power source detector 20 detects whether the power supplied into a system is from a battery or from external power, then outputs it through the microcomputer 16. Further, moreover, the light-sensor 14 outputs an electric signal that corresponds to the intensity of surrounding light, preferably through the A/D converter 15, and the A/D converter 15 converts the electric signal into a digital signal for transmitting to the microcomputer 16 (step S10).

Therefore, the source power, being used as the system power, and the intensity of surrounding light are known in the microcomputer 16. In the case where the source power is an applied AC power (step S11), the microcomputer 16 preferably searches through the memory 21, verifies the backlight control range of the table number #1 that corresponds with the condition and then sets the backlight control range to the corresponding range, e.g., up to the maximum of 100%. Hereinafter, the backlight driving current value, which is preferably inversely proportional to the detected intensity of surrounding light, is searched and extracted from the memory 21. Then, the backlight control operation is performed to apply the driving current, in correspondence with the extracted driving current value and backlight control range, into the backlight 13 via the power supply 17 (step S12). In addition, when the external AC power is used, an automatic control operation described previously, which varies the driving current that is applied into the backlight 13 is preferably optional and can be ignored.

When the verified source power is not the AC power, meaning a battery (or a selected one of batteries) is being used as a source power, and the detected current, in correspondence with the intensity of surrounding light, meets the value of the level 1 standard (e.g., between 4 mA and 9 mA)

(step S13), the microcomputer 16 searches through the memory 21, verifies the backlight control range of the table number #2 that corresponds with the condition and then sets the backlight control range up to a maximum of 75%. The backlight driving current value, preferably inversely proportional to the detected intensity of surrounding light, is searched and extracted from the memory 21. Then, the backlight control operation is performed to apply the driving current, in correspondence with the extracted driving current value and backlight control range, into the backlight 13 via the power supply 17 (step S14).

When the verified source power is a battery, and the detected current, in correspondence with the intensity of surrounding light, meets the value of the level 2 standard (e.g., between 10 mA and 14 mA) (step S15), the microcomputer 16 searches through the memory 21, verifies the backlight control range of the table number #3 that corresponds with the condition and sets the backlight control range up to a maximum of 50%. Then, the backlight driving current value, which is preferably inversely proportional to the detected intensity of surrounding light, is searched and extracted from the memory 21. Then, the backlight control operation is performed to apply the driving current, in correspondence with the extracted driving current value and backlight control range, into the backlight 13 via the power supply 17 (step S16).

When the verified source power is a battery, and the detected current, in correspondence with the intensity of surrounding light, meets the value of the level 3 standard (e.g., between 15 mA and 20 mA) (step S17), the microcomputer 16 searches through the memory 21, verifies the backlight control range of the table number #4 that corresponds with the condition and sets the backlight control range at maximum of 25%. Afterwards, the backlight driving current value, which is preferably inversely proportional to the detected intensity of surrounding light, is searched and extracted from the memory 21. Then, the backlight control operation is performed to apply the driving current, in correspondence with the extracted driving current value and backlight control range, into the backlight 13 via the power supply 17 (step S18). As shown in FIG. 4, after the driving current is applied (steps S12, S14, S16, S18), the process ends.

As described above, preferred embodiments according to the present invention utilized a single battery source and corresponding set of backlight control ranges. However, the present invention is not intended to be so limited. For example, a plurality of batteries could be used with external power where each battery was assigned a set of power conserving backlight control ranges that maintained brightness of an LCD that uses both external and backlight sources.

As described above, preferred embodiments of an LCD backlight control device and method have various advantages. The preferred embodiments of the LCD backlight control device and method is applicable to maintain the brightness of the reflective LCD, that can utilize light sources from both the backlight and the external light. Further, battery usage and overall power consumption for backlighting can be reduced or minimized and handheld electronic devices equipped with the reflective LCD are able to extend battery life.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A system that uses both light from a backlight device and ambient light to display signals on a screen, comprising:

a display device;

a backlight device that is capable of providing light to the display device;

a light-sensor, wherein the light sensor detects intensity of the ambient light;

a power supply that selects either a battery or an external power source as a power source to provide driving power of the backlight device;

a power source detector that detects the power source that provides the driving power of the backlight device; and a backlight control device coupled to the light-sensor and the power source detector that controls the power supply to apply a backlight driving current within a selected one of a plurality of backlight control ranges, wherein the plurality of backlight control ranges are different according to each of a detected ambient light intensity and the power source, wherein first and second backlight control ranges of the backlight control ranges are selected when the battery is selected.

2. The system of claim 1, wherein the backlight control device further comprises a memory unit coupled to the control unit that stores data of the different backlight control ranges that are designated into levels, wherein each of the levels are different.

3. The system of claim 2, wherein said memory unit stores information determining an inversely proportional relationship between the backlight driving current and the detected intensity of the ambient light.

4. The system of claim 1, wherein the backlight driving current has a prescribed relationship to the detected intensity of the ambient light, and wherein the backlight driving current is within the selected backlight control range.

5. The system of claim 1, wherein at least one of the backlight control ranges is applicable only for the external power source.

6. The system of claim 1, wherein the backlight control device consists of a microcomputer.

7. The system of claim 1, wherein at least a third backlight control range is selected when the external power source is selected.

8. The system of claim 7, wherein each of upper levels of the backlight control ranges are different.

9. The system of claim 1, wherein the battery comprises a first battery unit and a second battery unit.

10. A backlight control method of a display device, comprising:

detecting a selected one of a plurality of power sources supplying a backlight;

detecting intensity of surrounding light impinging the display device;

determining a plurality of backlight control ranges having different levels according to the detected surrounding light intensity and a power source;

selecting a backlight control range from among the backlight control ranges according to the detected surrounding light intensity and the detected power source; and controlling a backlight driving current in proportion to the detected surrounding light intensity within the selected backlight control range applied to the backlight, wherein the determining step determines at least a first backlight control range that is applicable for the external power source, and wherein at least two of the backlight control ranges are applicable for the battery.

11. The backlight control method of claim 10, wherein said detecting a selected one of power sources checks whether a source power is from a battery or an external power source.

12. The backlight control method of claim 11, wherein the first backlight control range is applicable only for the external power source.

13. The backlight control method of claim 10, wherein said selecting step sets a backlight control range from a lower limit to an upper limit of 100% when the power source is an external power source.

14. The backlight control method of claim 10, wherein said selecting step sets the selected range from a lower limit to an upper limit below 100%, the upper limit of the selected range being inversely related to the surrounding light intensity.

15. The backlight control method of claim 10, wherein the determining step determines at least one of the backlight control ranges is applicable only for a first one of the plurality of power sources.

16. The backlight control method of claim 12, wherein one of second and third backlight control ranges is selected when the detected power source is the battery, and wherein the first, second and third backlight control ranges are different.

17. The backlight control method of claim 16, wherein the second backlight control range is from a lower limit to an upper limit of 75%, wherein the third backlight control range is from a lower limit to an upper limit of 50%, wherein the detected surrounding light intensity is designated into one of a plurality of surrounding light levels.

18. The backlight control method of claim 17, wherein the lower limit is 0%.

19. The backlight control method of claim 10, wherein the display device comprises an LCD.

20. The system of claim 1, wherein the display device comprises a reflective LCD device.

21. The system of claim 7, wherein the first backlight control range is from a lower limit to an upper limit of 75%, wherein the second backlight control range is from a lower limit to an upper limit of 50%, wherein the detected ambient light intensity is designated into one of a plurality of surrounding tight levels.

22. The system of claim 1, wherein subsequent operator actions further adjust the driving current within the selected backlight control range.

23. An apparatus, comprising:

means for detecting a selected one of a plurality of power sources supplying a backlight;

means for detecting intensity of surrounding light impinging a display device;

means for determining a plurality of backlight control ranges having different levels according to the detected surrounding light intensity and the supplying power source;

means for selecting a backlight control range from among the backlight control ranges according to the detected surrounding light intensity and the detected power source; and means for controlling a backlight driving current in proportion to the detected surrounding light intensity within the selected backlight control range applied to the backlight, wherein the means for determining determines a first backlight control range and a second backlight control range that each can be selected when the detected power source is battery.

* * * * *